US010272584B2

(12) United States Patent
Alberti et al.

(10) Patent No.: US 10,272,584 B2
(45) Date of Patent: Apr. 30, 2019

(54) APPARATUS FOR SHEARING A METALLIC BELT FOR MANUFACTURING ELECTRIC ACCUMULATORS AND METHOD OF OPERATION OF SAID APPARATUS

(71) Applicant: SOVEMA GROUP S.P.A., Villafranca di Verona (IT)

(72) Inventors: Marco Alberti, Sasso Marconi (IT); Stefano Pol, Verona (IT)

(73) Assignee: SOVEMA GROUP S.P.A., Villafranca di Verona (IT)

( * ) Notice: Subject to any disclaimer, the term of this patent is extended or adjusted under 35 U.S.C. 154(b) by 0 days.

(21) Appl. No.: 15/723,204

(22) Filed: Oct. 3, 2017

(65) Prior Publication Data

US 2019/0099907 A1 Apr. 4, 2019

(51) Int. Cl.

| | |
|---|---|
| ***B26D 5/00*** | (2006.01) |
| ***B26D 5/02*** | (2006.01) |
| ***B26D 5/22*** | (2006.01) |
| ***B26D 1/60*** | (2006.01) |
| ***B65H 23/26*** | (2006.01) |
| ***B65H 20/16*** | (2006.01) |

(52) U.S. Cl.

CPC ..... *B26D 5/02* (2013.01); *B26D 1/60* (2013.01); *B26D 5/22* (2013.01); *B65H 20/16* (2013.01); *B65H 23/26* (2013.01); *B65H 2403/51* (2013.01); *B65H 2405/52* (2013.01)

(58) Field of Classification Search

CPC ... B26D 5/02; B26D 1/60; B26D 5/22; B65H 20/16; B65H 20/26; B65H 2403/51; B65H 23/26; B65H 2405/52

See application file for complete search history.

(56) References Cited

U.S. PATENT DOCUMENTS

| | | | | |
|---|---|---|---|---|
| 2,655,212 A | | 10/1953 | Stewart | |
| 5,277,571 A | | 1/1994 | Brining | |
| 6,003,420 A | * | 12/1999 | Wakabayashi | B26D 9/00 83/214 |
| 6,349,867 B1 | * | 2/2002 | Fernfors | B65H 20/08 156/265 |
| 8,408,110 B2 | * | 4/2013 | Krauss | B26F 1/40 83/436.9 |
| 9,144,624 B2 | * | 9/2015 | Schneider | B29C 65/08 |

FOREIGN PATENT DOCUMENTS

| | | |
|---|---|---|
| CN | 103979343 | 8/2014 |
| EP | 2320508 | 5/2011 |
| WO | 2008096051 | 3/2008 |
| WO | 2012110915 | 8/2012 |
| WO | 2013186745 | 12/2013 |

* cited by examiner

*Primary Examiner* — Omar Flores Sanchez
(74) *Attorney, Agent, or Firm* — Mark M. Friedman

(57) ABSTRACT

An apparatus is provided for shearing a metallic belt from which electrodes of electric accumulators are formed. The apparatus includes a cutting device able to shear a metallic belt advancing along a sliding path, a first slider positioned upstream of the cutting device and a second slider positioned downstream of the cutting device. A handling system drives the first slider and the second slider cyclically with corresponding outward and return strokes, in order to change the length of the sliding path in such a way as to stop cyclically successive portions of the metallic belt at the cutting device, maintaining constant the advancement velocity of the metallic belt upstream and downstream of the cutting device.

14 Claims, 2 Drawing Sheets

APPARATUS FOR SHEARING A METALLIC BELT FOR MANUFACTURING ELECTRIC ACCUMULATORS AND METHOD OF OPERATION OF SAID APPARATUS

FIELD OF THE INVENTION

The present invention relates to an apparatus for shearing a metallic belt for manufacturing electric accumulators and a method of operation of said apparatus.

The apparatus and the method of the invention are in the industrial sector of the production of electric accumulators and in particular of lithium-ion batteries.

The apparatus and the method of the invention are advantageously employed to shear a metallic belt from which are formed the electrodes of the electric accumulators, and in particular to shear the longitudinal edge of said metallic belt in such a way as to obtain a contoured profile comprising for example projecting flags to form the terminals of the electrodes.

DESCRIPTION OF THE RELATED ART

Electric accumulators, and in particular lithium-ion batteries, comprise one or more stacks of positive and negative electrodes, positioned alternating one above the other with an interposed separating layer made of dielectric material.

The electrodes of the accumulators are generally obtained starting from a metallic belt, which is subjected to several work processes, e.g. shearing and/or punching, to obtain a metallic plate provided with a contoured profile and intended to form a corresponding electrode of the accumulator. In particular, the contoured edge of the aforesaid metallic plate is provided with a projecting flag intended to form a corresponding electric terminal of the electrode.

More in detail, the metallic belt is subjected to a shearing process, in which at least one of the longitudinal edges of said metallic bel is cut according to a determined profile comprising in particular multiple aforesaid flags positioned at a determined distance from each other.

For this purpose, apparatuses for shearing metallic belts are known on the market, which comprise a support frame bearing a cutting device mounted thereon, and driving means able to feed the aforesaid cutting device with the metallic belt to be sheared. The latter comprises a lower mold that receives the metallic belt thereon and an upper mold positioned above the lower mold. The cutting device also comprises actuation means able to displace the aforesaid molds cyclically between an open configuration, in which the upper mold is distanced from the lower mold to allow the passage of the metallic belt, and a closed configuration, in which the upper mold is pushed against the lower mold in order to cut the portion of metallic belt interposed between the two molds.

Operatively, the driving means of the apparatus actuate the metallic belt to advance with intermittent motion, positioning in succession adjacent portions of the metallic belt between the two molds of the cutting device, in such a way that the molds, when brought to the closed configuration, effect the cutting of such portions.

In particular, at each working cycle of the cutting device, the driving means of the apparatus make the metallic belt advance by a determined distance (during a corresponding actuation interval) to position one of the portions of the metallic belt between the two molds of the cutting device and, subsequently, they make the metallic belt stop during a corresponding rest interval, in which the molds are brought to the closed configuration to cut the aforesaid portion of the metallic belt.

A drawback of the aforesaid known apparatuses is due to the fact that the intermittent motion of the metallic belt does not allow optimization of the production rate, because it is necessary to execute a rest interval of the metallic belt at each work cycle of the cutting device.

To solve this drawback at least in part, apparatuses to shear metallic belts have been introduced on the market in which the metallic belt is made to advance with a continuous motion and at constant speed.

For example, the patent application WO 2012/110915 describes an apparatus which comprises driving means comprising two driving grippers mounted on two corresponding carriages movable along the direction of advance of the metallic belt. Operatively, the carriage of each driving gripper can be actuated to be displaced with a reciprocating motion which entails an outward stroke, in which the driving gripper is actuated to grip the metallic belt to make advance, and a return stroke, in which the driving gripper releases the metallic belt and moves backwards without interfering therewith. The driving grippers are actuated to move according to the aforesaid reciprocating motion in a mutually offset manner, so that while one gripper carries out the outward stroke the other carries out the return stroke, in order to make the belt advance with a continuous motion.

The apparatus described in the patent application WO 2012/110915 further comprises a cutting device mounted on a transport carriage, which is able to slide along the direction of advance of the metallic belt. The transport carriage of the cutting device can also be actuated to be displaced with reciprocating motion having an outward stroke and a return stroke. During the aforesaid outward stroke, the transport carriage is displaced at the same speed as the metallic belt, in such a way that the cutting device can close on the metallic belt in a condition of zero relative speed between them, in order to reduce the risk of damage or deformation of the metallic belt itself.

The apparatus described in the patent application WO 2012/110915 has also been proven in practice not to be altogether free from drawbacks.

In particular, this apparatus is not able to assure a very high working rate of the cutting device (and hence a very high production quantity), because of the difficulty in displacing the high mass of the cutting device positioned on the transport carriage.

In addition, the placement of the movable cutting device on the transport carriage makes the apparatus particularly complex and costly to build.

In addition, the patent application WO 2013/186745 driving means that make the metallic belt advance with continuous motion and rotating tensioning means able to act on the metallic belt in such a way as to obtain cyclically a rest phase and an acceleration phase of the belt at the cutting device, maintaining constant the velocity of the metallic belt upstream and downstream of the cutting device itself.

In closer detail, these tensioning means comprise a first and a second rotating drums positioned respectively upstream and downstream of the cutting device. Each rotating drum bears, mounted in eccentric position, a roller able, as a result of the rotation of the rotating drum, to form cyclically a bight on the metallic belt in order to extend the length of the path travelled by the metallic belt.

Operatively, the first rotating drum is actuated to act on the metallic belt in such a way as to vary cyclically the length of its path (forming the aforesaid bight) in order to determine, at the cutting device, cycles comprising, each, a rest phase of the belt, in which the cutting device is closed to shear the metallic belt, and a recovery phase, in which the motion of the metallic belt is accelerated at the cutting device (in open position) to recover the segment of metallic belt accumulated in the previous rest phase. The motion of the second rotating drum is synchronized with that of the first rotating drum in such a way as to compensate the path variations of the metallic belt (and hence the speed variations thereof) at the cutting device, in order to maintain constant the speed of the metallic belt upstream of the second rotating drum.

The apparatus described in the patent application WO 2013/186745 has also been proven in practice not to be altogether free from drawbacks.

A first drawback is due to the fact that this known apparatus is operatively poorly flexible because, to change the contoured profile to be obtained on the metallic belt (e.g. to vary the distance between the projecting flags) it is necessary to replace or mechanically modify the rotating rollers, entailing the need to carry out long servicing operations to effect the modifications with consequent long interruption times of the productive cycle.

A further drawback is due to the fact that the rotating rollers of the tensioning means require careful set-up operations in order to regulate the speed variations of the metallic belt at the cutting device, with the consequent risk of low precision of the shearing operations.

SUMMARY OF THE INVENTION

In this situation, the problem at the basis of the present invention is therefore that of overcoming the drawbacks exhibited by the aforementioned known solutions, making available an apparatus for shearing a metallic belt for manufacturing electric accumulators and method of operation of said apparatus which make it possible to operate in a flexible manner, in particular with variations in the shape of the contoured profile to be manufactured on the metallic belt.

An additional purpose of the present invention is to make available an apparatus for shearing a metallic belt for manufacturing electric accumulators and method of operation of said apparatus that make it possible to operate in an entirely safe and reliable manner.

An additional purpose of the present invention is to make available an apparatus for shearing a metallic belt for manufacturing electric accumulators, which is constructively simple and economical to manufacture.

An additional purpose of the present invention is to make available an apparatus for shearing a metallic belt for manufacturing electric accumulators, which is simple to use and easy to install.

BRIEF DESCRIPTION OF THE DRAWINGS

The technical characteristics of the present invention, according to the aforesaid purposes, can be noted from the content of the appended claims, and its advantages shall become more readily apparent in the detailed description that follows, made with reference to the accompanying drawings, which represent a purely exemplifying, non limiting embodiment, in which:

DETAILED DESCRIPTION OF SOME PREFERRED EMBODIMENTS

Figure 1:
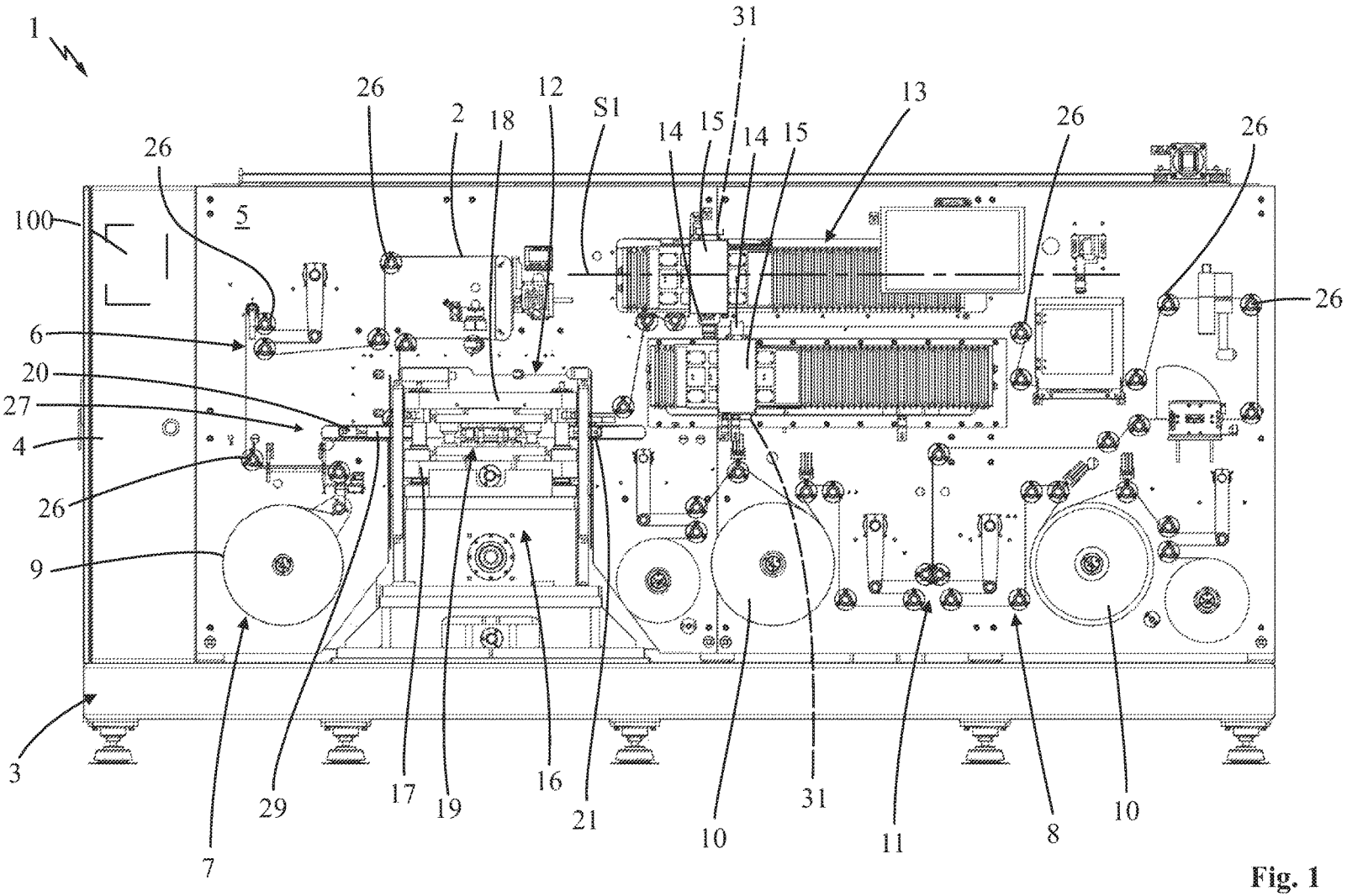
FIG. 1 shows a front view of the apparatus of the present invention, which some parts removed the better to highlight others.

With reference to the accompanying figures, the reference number 1 indicates in its entirety the apparatus for shearing a metallic belt for manufacturing electric accumulators of the present invention.

The apparatus 1 of the invention is advantageously employed in the sector of the production of electric accumulators to shear a metallic belt 2 from which the electrodes of the accumulators will be formed.

The apparatus is intended to be used in particular for shearing metallic belts for the production of the electrodes of lithium-ion batteries.

However, the apparatus 1 can also be used for manufacturing electric accumulators other than lithium-ion batteries, e.g. lead electric accumulators.

Advantageously, the apparatus 1 is intended to be used to cut at least one longitudinal edge of the aforesaid metallic belt 2, in such a way as to obtain a contoured profile comprising for example projecting flags able to form the terminals of the electric accumulators.

The metallic belt 2 sheared by the apparatus 1 in question is intended to be subjected to further subsequent work processes, such as in particular a transverse shearing, to obtain metallic plates that will constitute the electrodes of the electric accumulators.

In accordance with the embodiment illustrated in the accompanying figures, the apparatus 1 of the present invention comprises a support structure 3 to be set down on the ground and advantageously comprising a metallic frame 4, preferably box shaped, which delimits in its interior a housing compartment 5 in which are positioned the components of the apparatus 1 described below.

The support structure 3 of the apparatus 1 is provided with at least one sliding path 6 along which the metallic belt 2 is susceptible to advance.

In particular, the support structure 3 is provided with a feeding station 7 able to supply the metallic belt 2 to be sheared, and with an arrival station 8 at which the metallic belt 2 is accumulated after it is sheared.

In closer detail, the aforesaid feeding station 7 houses a first reel 9 which carries the wound metallic belt 2 to be cut and can be actuated to rotate to unwind the metallic belt 2 itself to allow the belt to advance along the aforesaid sliding path 6 towards the arrival station 8.

The arrival station 8 advantageously houses at least a second reel 10 able to be actuated to rotate, to wind the sheared metallic belt on itself.

In accordance with the particular example illustrated in FIG. 1, the arrival station 8 houses two second reels 10, each intended to wind a corresponding longitudinal semi-portion of the metallic belt 2 (each of which will be used to manufacture a corresponding series of electrodes) which longitudinal semi-portions are separated from each other at a separator device 11 positioned between the two second reels 10 and not described in detail inasmuch as it is known to the person skilled in the art.

Advantageously, the support structure 3 of the apparatus 1 comprises a cutting station 12, positioned along the sliding path 6 between the feeding station 7 and the arrival station 8, at which cutting station 12 the metallic belt 2 is sheared along at least one of its longitudinal edges to obtain the aforesaid contoured profile.

The apparatus 1 according to the invention comprises a driving system 13 able to make the metallic belt 2 advance with continuous movement along the sliding path 6 in an advancement direction V1, in particular from the feeding station 7 to the arrival station 8.

Preferably, the driving system 13 is adapted to make the metallic belt 2 advance with a constant advancement velocity in the segments of the driving path 6 upstream and downstream of the cutting station 12, as described below.

Advantageously, in in accordance with the particular example illustrated in FIG. 1, the driving system 13 comprises two driving grippers 14 mounted on two corresponding transport carriages 15, which are slidably mounted on the support structure 3 of the apparatus 1 and are movable along a segment of the sliding path 6 along a direction of displacement Al that is preferably rectilinear and in particular horizontal.

The driving system 13 further comprises two actuating motors 31 (schematically illustrated in FIG. 1), preferably of the linear type, each of which is mechanically connected to the corresponding transport carriage 15 to move the carriage along the aforesaid direction of displacement S1.

Operatively, the transport carriage 15 of each driving gripper 14 is actuated by the corresponding actuating motor 31 to be displaced with reciprocating motion along the direction of displacement S1, cyclically running an advancement stroke, in which the driving gripper 14 is actuated to grip the metallic belt 2 to make it advance along the sliding path 6, and a return stroke, in which the driving gripper 15 releases the metallic belt 2 to move backwards without interfering therewith. The driving grippers 14 are actuated to be displaced along the aforesaid reciprocating motion in a mutually offset manner, so that while one driving gripper 14 carries out the outward stroke, the other driving gripper 14 carries out the return stroke, in order to make the metallic belt 2 advance in the advancement direction V1 with continuous motion and preferably with constant advancement velocity.

According to the invention, the apparatus 1 comprises a cutting device 16 mounted preferably on the support structure 3 and positioned to intercept the sliding path 6, in particular at the cutting station 12.

The aforesaid cutting device 16 comprises a first mold 17 (preferably lower) provided with a first cutting face, and a second mold 18 (preferably upper) provided with a second cutting face facing towards the first cutting face of said first mold 17. The aforesaid cutting faces of the molds 17, 18 define between them a cutting zone 19 in which the cutting device is able to cut the metallic belt 2.

The metallic belt 2, actuated to advance by the driving system 13, is susceptible of passing between the first cutting face of the first mold 17 and the second cutting face of the second mold 18 to be sheared at the aforesaid cutting zone 19 of the cutting device 16 itself.

The cutting device 16 being able to be moved from an open configuration, in which the first cutting face of the first mold 17 is spaced from the second cutting face of said second mold 18 to allow the advancement of the metallic belt 2 between the first mold 17 and the second mold 18, and a closed configuration, in which the first cutting face of the first mold 17 is placed in abutment against the second cutting face of the second mold 18 to cut the metallic belt 2 at said cutting zone 19.

Advantageously, the cutting device is provided with actuators connected to the molds 17, 18 and able to actuate the molds cyclically to approach and move away from each other to position the cutting device 16 respectively in the closed configuration and in the open configuration.

Operatively, the cutting device 16 is actuated to carry out multiple working cycles, during each of which the cutting device 16 is brought to the closed configuration and subsequently to the open configuration.

Advantageously, the first cutting face of the first mold 17 is provided with at least one cutting edge shaped according to the contoured profile to be obtained along the longitudinal edge of the metallic belt 2, and preferably the second cutting face of the second mold 12 is provided with at least one cutting groove, complementarily shaped relative to the cutting edge of the first mold 17 and able to receive the cutting edge in shape relationship, to cut the metallic belt.

Figure 2:
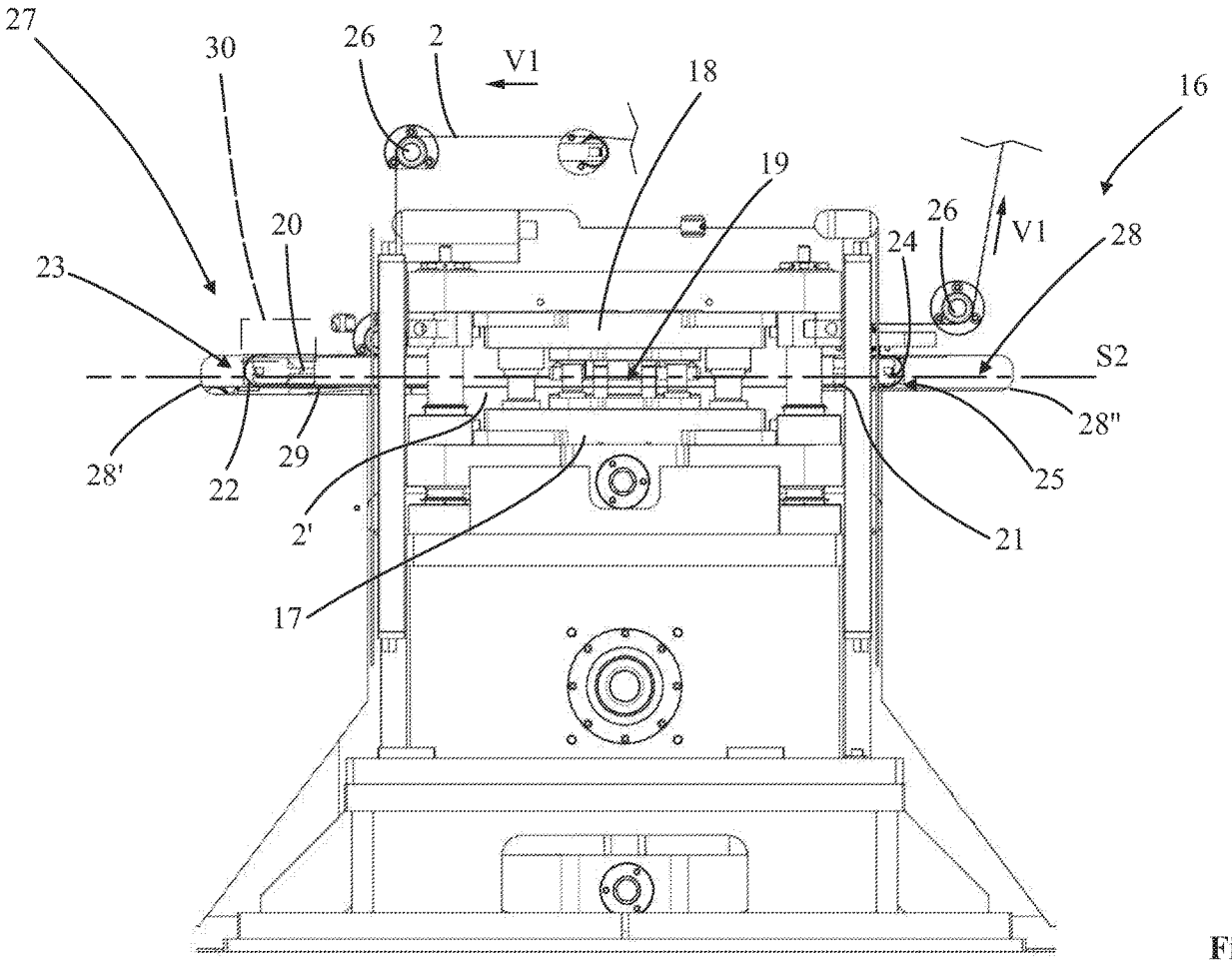
FIG. 2 shows a detail of the apparatus illustrated in FIG. 1, relating to a cutting device and to two movable sliders positioned upstream and downstream of the cutting device itself.

In accordance with the idea on which the present invention is based, the apparatus 1 comprises, with reference in particular to the example of FIG. 2, a first slider 20 and a second slider 21, which are slidably constrained to the support structure 3 to be displaced along the sliding path 6, and are positioned respectively upstream and downstream of the cutting device 16 relative to the advancement direction V1 of the metallic belt 2.

The apparatus 1 further comprises a first movable roller, which is rotatably mounted on the first slider 20, defines a first movable curve 23 of the sliding path 6 and is susceptible to engage the metallic belt 2 by bending it along said first movable curve 23.

The apparatus 1 further comprises a second movable roller 24, which is rotatably mounted on the second slider 21, defines a second movable curve 25 of the sliding path 6 and is susceptible to engage the metallic belt 2 by bending it along said second movable curve 25.

Preferably, the first movable curve 23 and the second movable curve 25 of the sliding path 6 are positioned each with the corresponding concavity facing towards the cutting device 16.

Advantageously, in accordance with the embodiment illustrated in FIG. 1, the sliding path 6, along which the metallic belt is susceptible to advance, is defined by multiple guide rollers 22, 24, 26, preferably idle, on which the metallic belt 2 is susceptible of sliding by bending around said guide rollers 22, 24, 26 in such a way as to form corresponding curves of the sliding path 6.

In particular, the guide rollers 22, 24, 26 comprise fixed rollers 26, hinged on the support structure 3 of the apparatus 1, and the aforesaid first and second movable roller 22 and 24 mounted respectively on the first and on the second slider 20 and 21.

According to the invention, the apparatus 1 comprise a handling system 27 mechanically connected to the first slider 20 and to the second slider 21 and able to actuate said sliders along the sliding path 6.

Further provided is a control unit 100 operatively connected to the handling system 27 and designed to drive its operation.

Advantageously, the control unit 100 (schematically illustrated in FIG. 1) comprises at least one programmable electronic module, such as a PLC, preferably provided with at least one electronic processor.

In particular, the aforesaid control unit 100 is designed to drive the handling system 27 to move the two sliders 20, 21 in a cyclical manner, with corresponding outward and return strokes, along the sliding path 6.

As described in detail below, the aforesaid outward stroke of the sliders 20, 21 enable to compensate the advancement of the metallic belt 2 along the sliding path 6 upstream of the cutting device 16, in such a way as to stop a portion 2' of the metallic belt 2 positioned at the cutting zone 19 of the cutting device 16 itself, to enable the latter to move to a closed configuration and hence to shear said portion 2' of the metallic belt 2 when it is stopped. The subsequent return strokes of the sliders 20, 21 enable to recover the part of metallic belt 2 that was accumulated upstream of the cutting device 16 during the previous outward strokes, causing the advancement of the portion 2' of metallic belt positioned in the cutting zone 19 of the cutting device 16 to bring to said cutting zone 19 the subsequent portion 2' of the metallic belt 2.

The movements of the first slider 20 (upstream of the cutting device 16) and of the second slider 21 (downstream of the cutting device 16) are synchronized in such a way that the advancement velocity of the metallic belt 2 in the segments of the sliding path 6 upstream and downstream of the cutting device 16 remains constant, as described in detail below.

In greater detail, the control unit 100 is designed to drive the handling system 27 to move, in a cyclical manner, the first slider 20 along the sliding path 6 between a first moving away position and a first approaching position, and to move, in a cyclical manner, the second slider 21 along the sliding path 6 between a second moving away position and a second approaching position.

In particular, when the first slider 20 is in the first moving away position, the second slider 21 is in the second approaching position and, when the first slider 20 is in the first approaching position, the second slider 21 is in the second moving away position.

In greater detail, when the first slider 20 is positioned in the first moving away position (as illustrated in the example of FIG. 2), the first movable roller 22 is moved by the first slider 20 away from the cutting device 16 along the sliding path 6, to extend the length of the sliding path 6 upstream of the cutting device 16 itself. When the first slider 20 is positioned in the first approaching position, the first movable roller 22 is moved by the first slider 20 closer to the cutting device 16 along the sliding path 6, to shorten the sliding path 6 upstream of the cutting device 16 itself.

In this way, advantageously, the extension of the length of the sliding path 6 (upstream of the cutting device 16), obtained bringing the first slider 20 to the first moving away position, enables to compensate the advancement of the metallic belt 2 accumulating a compensation segment of the metallic belt 2 itself upstream of the cutting device 16 and in particular between the latter and the first movable roller 22. This allows to stop the portion 2' of metallic belt 2 positioned at the cutting zone 19 of the cutting device 16, in particular maintaining constant the advancement velocity of the metallic belt 2 upstream of the first movable roller 22.

The shortening of the sliding path 6 (upstream of the cutting device 16), obtained bringing the first slider 20 to the first approaching position, enables to recover the aforesaid compensation segment of the metallic belt 2, causing the advancement of the portion 2' of metallic belt 2 positioned in the cutting zone 19 of the cutting device 16, in particular maintaining constant the advancement velocity of the metallic belt 2 upstream of the first movable roller 22.

When the second slider 21 is in the second approaching position (with the first slider 20 simultaneously in the first moving away position, as in the example of FIG. 2), the second movable roller 24 is brought by the second slider 21 approaching the cutting device 16 along the sliding path 6 to shorten the sliding path 6 downstream of the cutting device 16 itself. When the second slider 21 is in the second approaching position (with the first slider 20 simultaneously in the first approaching position), the second movable roller 24 is brought by the second slider 21 away from the cutting device 16 along the sliding path 6 to extend the sliding path 6 downstream of the cutting device 16 itself.

In this way, advantageously, the shortening of the sliding path 6 (downstream of the cutting device 16), obtained bringing the second slider 21 to the second approaching position, enables to recover the lengthening of the sliding path 6 upstream of the cutting device 16 (obtained by simultaneously bringing the first slider 20 to the first moving away position), enabling the advancement of the metallic belt downstream of the second movable roller 24 (in particular with constant advancement velocity) while the portion 2' of the metallic belt 2 positioned in the cutting zone 19 of the cutting device 16 remains stopped.

The lengthening of the sliding path 6 (downstream of the cutting device 16), obtained bringing the second slider 21 to the second moving away position, enables to compensate the shortening of the sliding path 6 upstream of the cutting device 16 (obtained by simultaneously bringing the first slider 20 to the first approaching position), in such a way as to maintain constant the advancement velocity of the metallic belt 2 downstream of the second movable roller 24.

Advantageously, with reference to the example shown in FIG. 2, the handling system 27 of the apparatus 1 (able to actuate the displacement of the sliders 20, 21) comprises a guide 28, preferably straight, fastened to the support structure 3 and to which are slidably connected the sliders 20, 21. The guide 28 extends along a sliding direction S2 parallel to a corresponding segment, preferably straight, of the sliding path 6 and along which sliding direction S2 the sliders 20, 21 are susceptible to move.

Preferably, the guide 28 is parallel to the cutting faces 17, 18 of the cutting device 16 and, in particular, it is orthogonal to the direction of cutting along which the molds 17, 18 move to actuate the cutting device 16 between the open configuration and the closed configuration.

Advantageously, the guide 28 is positioned in the cutting station 12 of the apparatus 1 and extends between its first end 28' located upstream of the cutting device 16 (relative to the advancement direction V1 of the metallic belt 2 along the sliding path 6), and its second end 28" located downstream of the cutting device 16 (relative to the advancement direction V1 of the metallic belt 2 along the sliding path 6).

In accordance with the embodiment illustrated in the accompanying figures, the guide 28 is obtained with a single rail to which are engaged both sliders 20, 21.

In particular, the handling system 27 comprises a carriage 29 slidably engaged to the guide 28 and bearing fastened both the first slider 20 and the second slider 21, which therefore are integral to each other.

Moreover, the handling system 27 comprises at least one handling motor 30 (schematically shown in FIG. 2) mounted on the support structure 3 and mechanically connected to the carriage 29 to move the carriage along the guide 28. Preferably, the aforesaid handling motor 30 is linear and in particular with high acceleration.

In accordance with a different embodiment, not illustrated in the accompanying drawings, the guide 28 is obtained with at least two distinct rails, each of which bears slidably engaged the slider 20, 21.

Advantageously, in accordance with the embodiment illustrated in FIG. 2, the first movable curve 23 of the sliding path 6 bends by 180° around the first movable roller 22 with the upstream and downstream segments of said first movable curve 23 arranged parallel to each other.

Similarly, the second movable curve 25 of the sliding path 6 bends preferably by 180° around the second movable roller 24, with the upstream and downstream segments of said second movable curve 25 arranged parallel to each other.

The two movable curves 23, 25 have, in particular, their corresponding concavities facing towards the cutting device 16.

The control unit 100 of the apparatus 1 is designed to drive the handling system 27 to displace the first slider 20 from the first approaching position to the first moving away position with substantially equal velocity, in absolute value terms, to half the advancement velocity of the metallic belt 2 along the sliding path 6.

In this way, the first movable roller 22, actuated by the first slider 20, extends the sliding path 6 by the same length upstream and downstream of the first movable curve 23. Therefore, the first server 20, moving at half the advancement velocity of the metallic belt 2, overall extends the sliding path 6, per time unit, by the same length over which the metallic belt 2 travels, per unit of time, at the aforesaid advancement velocity. In this way, therefore, when the first slider 20 moves from the first approaching position to the first moving away position, the portion 2' of metallic belt 2 located downstream of the first movable curve 23, and in particular at the cutting zone 19 of the cutting device 16, remains substantially stopped along the sliding path 6.

Similarly, the control unit 100 of the apparatus 1 is preferably designed to drive the handling system 27 to move the second slider 21 from the second moving away position to the second approaching position with substantially equal velocity, in absolute value, to half the advancement velocity of the metallic belt 2 along the sliding path 6, in such a way as to shorten the sliding path 6 downstream of the cutting device 16 in a synchronized manner with the lengthening of the sliding path 6 (upstream of the cutting device 16) determined by the first slider 20.

The present invention also relates to a method of operation of an apparatus for shearing a metallic belt for the manufacturing electric accumulator of the type described above.

Hereafter, for simplicity of description, reference shall be made to the same nomenclature introduced hitherto, although it shall be understood that the present method can also be obtained with apparatuses not provided with all the characteristics considered above.

According to the method of the invention, the metallic belt 2 is actuated to advance with continuous movement along the sliding path 6 in the advancement direction V1, preferably with constant advancement velocity, in particular by the aforesaid driving system 13 of the apparatus 1 acting on the metallic belt 2 itself.

Advantageously, the metallic belt 2, following the actuation of the driving system 13, is unwound from the first reel 9 (located in the feeding station 7 of the apparatus 1) and advances towards the cutting device 16.

The metallic belt 2, in particular when it arrives at the cutting station 12 of the apparatus 1, bends around the first movable roller 22 along the first movable curve 23 of the sliding path 6, passes between the first cutting face of the first mold 17 and the second cutting face of the second mold 18 of the cutting device 16, and thence it bends around the second movable roller 24 along the second movable curve 25 of the sliding path 6.

Advantageously, the metallic belt 2 exiting the cutting station 12 continues along the sliding path 6 towards the arrival station 8 where it is wound around the corresponding second reel 10.

In accordance with the idea on which the present invention is based, the method entails actuating the first slider 20 to run in a cyclical manner a first outward stroke and a first return stroke.

The first slider 20, therefore, is actuated to run in succession several first handing cycles, each of which comprises an aforesaid first outward stroke and a subsequent aforesaid first return stroke.

In greater detail, in the aforesaid first outward stroke, the first slider 20 moves the first movable roller 22 away from the cutting device 16 along the sliding path 6 to lengthen the latter downstream of the cutting device 16 itself. In the aforesaid first return stroke, the first slider 20 moves the first movable roller 22 closer to the cutting device 16 along the sliding path 6 to lengthen the latter downstream of the cutting device 16 itself.

In this way, advantageously, the extension of the length of the sliding path 6 (upstream of the cutting device 16), obtained during the first outward stroke of the first slider 20, enables to compensate the advancement of the metallic belt 2 accumulating a compensation segment of the metallic belt 2 between the first movable roller 22 and the cutting device 16. This allows to stop the portion 2' of metallic belt 2 positioned in the cutting zone 19 of the cutting device 16, whilst enabling the metallic belt 2 to continue to advance (in particular with constant advancement velocity) in the segment of the sliding path 6 located upstream of the first movable roller 22.

The shortening of the sliding path 6 (upstream of the cutting device 16), obtained during the first approaching stroke of the first slider 20, enables to recover the aforesaid compensation segment of the metallic belt 2, causing the advancement of the portion 2' of metallic belt 2 positioned at the cutting zone 19 of the cutting device 16.

Moreover, the method of the invention enables to actuate the second slider 21 to run in a cyclical manner a second outward stroke, when the first cursor 20 runs the first outwards stroke, and a second return stroke, when the first slider 20 runs its first return stroke.

The second slider 21, therefore, is actuated to run in succession several first handing cycles, each of which comprises an aforesaid second outward stroke and a subsequent aforesaid second return stroke.

In the aforesaid second return stroke, the second slider 21 moves the second movable roller 24 closer to the cutting device 16 along the sliding path 6 to shorten the latter downstream of the cutting device 16 itself.

In the aforesaid second return stroke, the second slider 21 moves the second movable roller 24 away from the cutting device 16 along the sliding path 6 to lengthen the latter downstream of the cutting device 16 itself.

In this way, advantageously, the shortening of the sliding path 6 (downstream of the cutting device 16), obtained during the second outward stroke of the second slider 21, enables to recover the lengthening of the sliding path 6 upstream of the cutting device 16 (obtained during the simultaneous first outward stroke of the first slider 20), in such a way as to enable the metallic belt 2 to proceed, in particular with constant advancement velocity, in the segment of the sliding path 6 downstream of the second movable roller 24.

The lengthening of the sliding path 6 (downstream of the cutting device 16), obtained during the second return stroke of the second slider 21, enables to compensate the shortening of the sliding path 6 upstream of the cutting device 16 (obtained during the simultaneous first return stroke of the first slider 20), in such a way as to enable the metallic belt 2 to proceed, in particular with constant advancement velocity, in the segment of the sliding path 6 downstream of the second movable roller 24.

In accordance with the above description, during the first outward stroke of the first slider 20 and the second outward stroke of the second slider 21, the portion 2' of the metallic belt 2 situated at the cutting zone 19 of the cutting device 16 is stopped relative to the cutting device 16 along the sliding path 6.

During the aforesaid first and second outward stroke, according to the method of the invention the cutting device 16 is actuated to reach the closed configuration to cut the metallic belt 2 at the cutting zone 19.

In this way, the shearing of the metallic belt 2 is carried out when the portion 2' of the metallic belt (positioned in the cutting zone 19) is stopped, allowing to cut the longitudinal edge of the metallic belt 2 in an extremely precise manner, without the risks of deformations of the metallic belt 2 or imperfections of the contoured profile obtained.

In particular, during the first outward stroke of each first handling cycle of the first slider 20, the cutting device 16 is actuated to carry out a corresponding working cycle in which it is brought to the closed configuration and subsequently to the open configuration.

During the first return stroke of each first handling cycle of the first slider 20, the cutting device 16 is positioned in its open configuration to allow the metallic belt 2 to advance between the two molds 17, 18 of the cutting device 16 itself.

Advantageously, during the first outward stroke of the first slider 20, the sliding path 6, upstream of cutting device 16 (and in particular between the latter and the first movable roller 22), is extended, per unit of time, by a compensation length substantially equal to a segment of the sliding path 6 that is travelled by the metallic belt 2 during the same unit of time.

Therefore, the first slider 20 in its first outwards stroke extends overall the sliding path 6, per time unit, by the same length of the segment of the sliding path 6 that the metallic belt travels, per time unit, at the aforesaid advancement velocity. In this way, when the first slider 20 runs the first outward stroke, the portion 2' of metallic belt 2 located downstream of the first movable curve 23, and in particular at the cutting zone 19 of the cutting device 16, remains substantially stopped along the sliding path 6.

Advantageously, during the second outward stroke of the second slider 21, the sliding path 6, downstream of the cutting device 16 (and in particular between the latter and the second movable roller 24), is shortened, per unit of time, by a recovery length substantially equal to the segment of the sliding path 6 that is travelled by the metallic belt 2 during the same unit of time. Such shortening of the sliding path 6 therefore has equal length to that of the aforesaid extension of the sliding path 6 upstream of the cutting device 16 (determined by the first outward stroke of the first slider 20) and, hence, it enables to compensate this lengthening upstream, enabling to maintain constant the advancement velocity of the metallic belt 2 downstream of the second movable roller 24 (and therefore downstream of the cutting station 12).

Advantageously, the first slider 20 moves integrally with the second slider 21, being in particular the two sliders 20, 21 fastened to the same carriage 29.

As stated previously, the metallic belt 2 is made to advance preferably with constant advancement velocity along the sliding path 6 upstream and downstream of the cutting device 16.

According to the method of the invention, the first slider 20, during at least one segment of its first outward stroke, and the second slider 21, during at least one segment of its second outward stroke, move with constant velocity.

During this segment at constant velocity of the first and of the second outward stroke respectively of the first and of the second slider 20 and 21, the velocity of the sliders 20, 21 is such that the portion 2' of metallic belt 2 positioned in the cutting zone 19 of the cutting device 16 remains stopped along the sliding path 6, allowing the cutting device 16 to reach the closed configuration to shear said portion 2' of the metallic belt 2.

The duration of the first outward stroke (which corresponds to the time interval in which the portion 2' of the metallic belt 2 remains stopped at the cutting zone 19 of the cutting device 16) is greater than or equal to the time the cutting device takes to execute a work cycle in which it moves from the open configuration to the closed configuration to cut the metallic belt 2 and from the closed configuration to the open configuration to be separated from the cut metallic belt 2.

Advantageously, according to the embodiment of the apparatus 1 illustrated in the accompanying figure, the first slider 20, during its first outward stroke, and the second slider 21, during its second outward stroke, move at a displacement velocity equal, in absolute value, to half of the advancement velocity of the metallic belt 2.

In this way, the first movable roller 22, during the first outward stroke of the first slider 20, extends the sliding path 6 by the same length upstream and downstream of the first movable curve 23 which (as stated above) bends by 180° around the first movable roller 22 with the segments upstream and downstream thereof arranged parallel to each other.

Therefore, the first slider 20, moving at half the advancement velocity of the metallic belt 2, overall extends the sliding path 6, per time unit, by the same length which the metallic belt 2 travels, per time unit, at the aforesaid advancement velocity. In this way, when the first slider 20 runs the first outward stroke, the portion 2' of metallic belt 2 located downstream of the first movable curve 23, and in particular at the cutting zone 19 of the cutting device 16, remains substantially stopped along the sliding path 6.

In this way, the second movable roller 24, during the second outward stroke of the second slider 21, extends the sliding path 6 by the same length upstream and downstream of the second movable curve 25 which (as stated above) bends by 180° around the second movable roller 24 with the segments upstream and downstream thereof arranged parallel to each other.

Therefore, the second slider 21, moving at half the advancement velocity of the metallic belt 2, overall extends the sliding path 6, per time unit, by the same length which the metallic belt 2 travels, per time unit, at the aforesaid advancement velocity. In this way, when the second slider 21 runs the second outward stroke, it enables the metallic belt 2 to continue to advance downstream of the cutting device 16 with the aforesaid advancement velocity, although the portion of the metallic belt 2 positioned in the cutting zone 19 of the cutting device 16 is stopped.

The method of the invention advantageously enables to shear portions 2' of the metallic belt 2 positioned at the same distance from each other, in such a way as to shape the longitudinal edge of the metallic belt 2 with a contour that is repeated regularly and with constant pitch along the longitudinal development of the metallic belt 2 itself. In particular, the method of the invention preferably enables to manufacture the projecting flags (which will constitute the terminals of the electrodes) positioned at the same distance from each other along the metallic belt 2.

For this purpose, according to a first embodiment of the method of the invention, the velocity of the first slider 20 during the first return stroke of each first handling cycle is equal to the velocity of the first slider 20 during the first return stroke of the first subsequent handling cycle.

As stated above, the portion 2' of metallic belt 2 positioned in the cutting zone 19 of the cutting device 16 remains stopped during the outward strokes of the sliders 20, 21 (to enable the cutting device 16 to cut the metallic belt 2) and advances during the return strokes of the sliders 20, 21 to enable the subsequent portion to be brought to the cutting zone 19.

Maintaining the velocity of the first slider 20 during each first return stroke equal to that of the first return stroke of the first subsequent handling cycle, the metallic belt 2 is made to advance to the cutting zone 19 of the cutting device 16 with advancement strokes having constant pitch, therefore allowing to stamp the projecting flags at the same distance from each other.

Advantageously, the duration of the first outward stroke of the first slider 20 is equal to the duration of the first return stroke of the first slider 20 (and, similarly, the duration of the second outward stroke of the second slider 21 is equal to the duration of the second return stroke of the second slider 21).

For example, setting the cutting device 16 to execute 300 working cycles per minute (and hence execute 300 shearing operations per minute on the metallic belt 2), the first outward stroke of each first handling cycle of the first slider 20 lasts 100 ms and the first return stroke of each first handling cycle of the first slider 20 lasts 100 ms.

The method of the invention advantageously enables to shear portions 2' of the metallic belt 2 positioned at different distances from each other, in such a way as to shape the longitudinal edge of the metallic belt 2 with a contour that is repeated with variable pitch along the metallic belt 2 itself.

For example, the method of the invention enables to contour the longitudinal edge of the metallic belt 2 with distance between the successive portions 2' of the metallic belt 2 which, for a determined series of portions 2', increases from the first to the last of the portions 2' of that series.

In particular, the method of the invention enables to manufacture multiple series of projecting flags, wherein in each series the distances between adjacent flags increase (or decrease) going from the first to the last flag of the series. This shape of the contoured profile of the longitudinal edge of the metallic belt 2 advantageously enables to manufacture electric accumulators in which the electrodes are shaped as a contoured belt wound around a central support with, for example, plate-like shape. Since the winding width increases at each winding of the contoured belt around the support, the terminals (and hence the projecting flags) need to be manufactured at a distance from the each other that grows starting from the innermost to the outermost end of the contoured belt, in order to arrange all the terminals of the electrode mutually aligned, compensating the increase in the width of the windings.

For this purpose, according to the method of the invention, the velocity of the first slider 20 during the first return stroke of each first handling cycle is different from the velocity of the first slider 20 during the first return stroke of the subsequent first handling cycle. Varying the velocity of the first slider 20 during the first return stroke of each first handling cycle, e.g. setting the velocity of the first slider 20 in the first outward stroke lower than the one assumed during the preceding first handling cycle, the metallic belt is made to advance to the cutting zone 19 of the cutting device 16 with advancement strokes having growing pitch from a first handling cycle to the next, thus enabling the cutting device 16 to stamp the projecting flags at increasing distance from each other.

Preferably, the second slider 21, during its second outward and return strokes, has the same velocities as the first slider 20 during, respectively, the first outward and return strokes thereof, in such a way as to synchronize the movements of the second slider 21 with the movements of the first slider 20 described above.

The invention thus conceived therefore achieves its stated purposes.

In particular, the arrangement of the sliders 20, 21 of the apparatus 1 of the invention and their actuation according to the method of operation of the invention enable to execute the process of shearing the metallic belt 2 in a highly flexible manner. To vary, for example, the distance between the projecting flags of the contoured profile to be obtained on the metallic belt 2, it is sufficient to program the control unit 100 setting the desired laws of motion of the sliders 20, 21, e.g. setting corresponding electronic cams in the control unit 100, with no need to make any mechanical modification to the apparatus 1.

The invention claimed is:

1. Apparatus for shearing a metallic belt for manufacturing electric accumulators, such apparatus comprising:

a support structure provided with at least one sliding path along which a metallic belt is configured for advancing;

a driving system configured to advance said metallic belt with a continuous movement along said sliding path in an advancement direction (V1);

a cutting device positioned to intercept said sliding path, and comprising:

at least one first mold provided with a first cutting face and at least one second mold provided with a second cutting face facing towards the first cutting face of said first mold to define with said first cutting face at least one cutting zone, said metallic belt being configured for passing between the first cutting face of said first mold and the second cutting face of said second mold;

said cutting device being able to be moved from an open configuration, in which the first cutting face of said first mold is spaced from the second cutting face of said second mold to allow the advancement of said metallic belt between said first mold and said second mold, and a closed configuration, in which the first cutting face of said first mold is placed in abutment against the second cutting face of said second mold to cut said metallic belt at said cutting zone;

said apparatus also comprising:

a first slider slidably constrained to said support structure to move along said sliding path and placed upstream of said cutting device with respect to said advancement direction (V1);

a second slider slidably constrained to said support structure to move along said sliding path and placed downstream of said cutting device with respect to said advancement direction (V1);

a first movable roller, which is rotatably mounted on said first slider, defines at least a first movable curve of said sliding path and is configured for engaging said metallic belt by bending said metallic belt along said first movable curve;

a second movable roller, which is rotatably mounted on said second slider, defines at least a second movable curve of said sliding path and is configured for engaging said metallic belt by bending said metallic belt along said second movable curve;

a handling system mechanically connected to said first slider and to said second slider and configured to move said first slider and said second slider along said sliding path;

a control unit operatively connected to said handling system and configured to drive said handling system:

to move in a cyclic way said first slider along said sliding path from a first moving away position, in which said first movable roller is brought by said first slider away from said cutting device along said sliding path to make said sliding path longer upstream of said cutting device, and a first approaching position, in which said first movable roller is brought by said first slider closer to said cutting device along said sliding path to make said sliding path shorter upstream of said cutting device, and to move in a cyclic way said second slider along said sliding path from a second approaching position in which, with said first slider in said first moving away position, said second movable roller is brought by said second slider closer to said cutting device along said sliding path to make said sliding path shorter downstream of said cutting device, and a second moving away position in which, with said first slider in said first approaching position, said second movable roller is brought by said second slider away from said cutting device along said sliding path to make said sliding path longer downstream of said cutting device.

2. Apparatus according to claim 1, wherein said handling system comprises at least one straight guide, secured to said support structure and extending along a sliding direction (S2) parallel to a corresponding straight section of said sliding path, and along such sliding direction (S2) said sliders are configured for moving.

3. Apparatus according to claim 2, wherein said handling system comprises:

a carriage slidably constrained to said guide and carrying secured first slider and second slider;

at least one handling motor mounted on said support structure and mechanically connected to said carriage to move said carriage along said guide.

4. Apparatus according to claim 2, wherein said guide is substantially parallel to the cutting faces of the molds of said cutting device.

5. Apparatus according to claim 1, wherein said first movable curve bends at 180 degrees around said first movable roller;

said control unit being configured to drive said handling system to move said first slider from said first approaching position to said first moving away position at a substantially equal velocity, in absolute value, to half of the advancement velocity of said metallic belt along said sliding path.

6. Apparatus according to claim 1, wherein said control unit comprises at least one programmable electronic module.

7. Apparatus according to claim 1, wherein said driving system comprises:

at least two driving grippers mounted on two corresponding transport carriages, which are slidably mounted on said support structure and are movable along a segment of said sliding path according to a direction of displacement (S1);

at least two actuating motors, each of which is mechanically connected to the corresponding said transport carriage to move said transport carriage along said direction of displacement (S1).

8. Method of operation of an apparatus for shearing a metallic belt for manufacturing electric accumulators according to claim 1, such method of operation providing for:

the advancement with a continuous movement of said metallic belt along said sliding path in an advancement direction (V1), and such metallic belt bends around said first movable roller along the first movable curve of said sliding path, passes between the first cutting face of said first mold and the second cutting face of said second mold, and bends around said second movable roller along the second movable curve of said sliding path;

the operation of said first slider to run in a cyclic way:

a first outward stroke, in which said first slider moves said first movable roller away from said cutting device along said sliding path to make said sliding path longer upstream of said cutting device, and a first return stroke, in which said first slider moves said first movable roller closer to said cutting device along said sliding path to make said sliding path shorter upstream of said cutting device;

the operation of said second slider to run in a cyclic way:

a second outward stroke when said first slider runs said first outward stroke, in which second outward stroke said second slider moves said second movable roller closer to said cutting device along said sliding path to make said sliding path shorter downstream of said cutting device, and a second return stroke when said first slider runs said first return stroke, in which second return stroke said second slider moves second movable roller away from said cutting device along said sliding path to make said sliding path longer downstream of said cutting device;

during said first outward stroke of said first slider and during said outward stroke of said second slider, said metallic belt being stationary at said cutting zone along said sliding path;

the operation, during said first outward stroke and said second outward stroke, of said cutting device to shift to said closed configuration in order to cut said metallic belt at said cutting zone.

9. Method according to claim 8, wherein said first slider moves in an integral way with said second slider.

10. Method according to claim 8, wherein said metallic belt is advanced at a constant advancement velocity along said sliding path upstream and downstream of said cutting device, wherein said first slider, during at least one section of said first outward stroke, and said second slider, during at least one section of said second outward stroke, move at a constant velocity.

11. Method according to claim 10, wherein said first slider, during at least one section of said first outward stroke, and said second slider, during at least one section of said second outward stroke, move at a displacement velocity equal, in absolute value, to substantially half of the advancement velocity of the metallic belt.

12. Method according to claim 8, wherein said first slider is operated to run in succession a number of first handling cycles, each of which comprising one said first outward stroke and one subsequent said first return stroke;

the velocity of said first slider during said first return stroke of each said first handling cycle being equal to the velocity of said first slider during the first return stroke of the subsequent said first handling cycle.

13. Method according to claim 8, wherein said first slider is operated to run in succession a number of first handling cycles, each of which comprising one said first outward stroke and one subsequent said first return stroke;

the velocity of said first slider during said first return stroke of each said first handling cycle differs from the velocity of said first slider during the first return stroke of the succeeding said first handling cycle.

14. Method according to claim 8, wherein, during said first outward stroke, said sliding path, upstream of said cutting device, is lengthened, per time unit, by a compensation length substantially equal to one section of said sliding path which is travelled by said metallic belt during said time unit.

* * * * *